US005927436A

United States Patent [19]

Schutz

[11] Patent Number: 5,927,436

[45] Date of Patent: Jul. 27, 1999

[54] FOLDABLE SAWHORSE/WORKTABLE

[76] Inventor: Stephen J Schutz, 6519 Killdeer Dr., Lino Lakes, Minn. 55014

[21] Appl. No.: 08/977,211

[22] Filed: Nov. 24, 1997

[51] Int. Cl.[6] ..... E04G 1/34

[52] U.S. Cl. ..... 182/153; 182/154; 182/181.1; 182/186.3; 182/224; 182/225; 248/164; 108/118

[58] Field of Search ..... 182/153, 154, 182/181.1, 186.3, 224, 225; 108/118, 119; 248/164

[56] References Cited

U.S. PATENT DOCUMENTS

| | | | |
|---|---|---|---|
| 1,279,023 | 7/1918 | Dunn . | |
| 1,406,888 | 2/1922 | Pandolfo | 182/154 X |
| 2,194,027 | 3/1940 | McDonald | 182/181.1 X |
| 2,480,702 | 8/1949 | Bradford . | |
| 2,727,564 | 12/1955 | Gruber | 108/118 X |
| 2,900,158 | 5/1959 | Ditter | 182/153 X |
| 2,905,263 | 9/1959 | Andersson | 182/154 |
| 3,276,545 | 10/1966 | D'Angelo | 182/153 |
| 4,102,555 | 7/1978 | Tobolski . | |
| 4,681,187 | 7/1987 | Brown | 182/153 X |
| 4,951,782 | 8/1990 | Hanson | 182/225 X |
| 5,465,673 | 11/1995 | Ma | 108/118 |
| 5,535,847 | 7/1996 | DuRapau . | |
| 5,647,455 | 7/1997 | Russell | 182/225 X |
| 5,657,703 | 8/1997 | Johnson | 108/118 |

*Primary Examiner*—Daniel P. Stodola
*Assistant Examiner*—Richard M. Smith
*Attorney, Agent, or Firm*—Michael I. Kroll

[57] ABSTRACT

A foldable sawhorse/worktable (10) comprising a work platform (12), a pair of scissor side support assemblies (14) and a pair of cross braces (16) horizontally extending between the scissor side support assemblies (14) for stabilization purposes. Structures (18) are for pivotally mounting top ends of each scissor side support assembly (14) to the underside (20) of the work platform (12). It can be placed into a folded position with the work platform (12) vertical to be conveniently stored and can be placed into an unfolded working position with the work platform (12) horizontal to support various types of power tools and all kinds of construction materials.

1 Claim, 3 Drawing Sheets

FOLDABLE SAWHORSE/WORKTABLE

BACKGROUND OF THE INVENTION

1. Field of the Invention

The instant invention relates generally to support structures and more specifically it relates to a foldable sawhorse/worktable. The foldable sawhorse/worktable can be placed into a folded position, so that it can be conveniently stored. It is lightweight so that it can be easily carried with one arm. The foldable sawhorse/worktable can be placed into an unfolded working position, in which its work platform can support various types of power tools and all kinds of construction materials.

2. Description of the Prior Art

Numerous support structures have been provided in prior art. For example, U.S. Pat. Nos. 1,272,023 to Dunn; 2,480,702 to Bradford; 4,102,555 to Tobolski and 5,535,847 to DuRapau all are illustrative of such prior art. While these units may be suitable for the particular purpose to which they address, they would not be as suitable for the purposes of the present invention as heretofore described.

DUNN, GEORGE W.

COLLAPSIBLE FRAME

U.S. Pat. No. 1,272,023

A collapsible frame consisting of an outer pair of props. An inner pair of props are within the outer pair. The props of one pair being permanently pivoted to the props of the other pair approximately midway between the ends of the props. A supporting bar is permanently pivoted near one of its ends between the upper ends of the props of the inner pair and is provided with a notch in its under side near it other end where it is adapted to occupy a position between the spaced upper ends of the props of the outer pair. A stop bar extending across this space is adapted to be received by the notch mentioned and is bent to extend downwardly on the outer props to which props below their upper ends it is non-rigidly rigidly connected at its ends by pivot bolts. A transverse brace is also pivotally connected to the same props at each of its ends by these same bolts. A sectional brace is non-rigidly rigidly connected to the props of one of the pairs below the brace first mentioned. When the sectional brace is adjusted to its bracing position, the outer props are caused to spread below their pivotal connections to the other brace which connections become fulcrums on which the props swing, so as to cause the upper ends of the props above the brace to move against the sides of the supporting bar, thereby clamping the same and holding it by means of the engagement of the notch therein with the stop bar. The pivotal connection of this upper brace to the outer props being so spaced from the upper ends of these props as to produce the aforesaid clamping effect upon the supporting bar. The upper brace being of such a length that when the frame is collapsed, it permits the four props with the supporting bar between them to be compactly closed up against each other.

BRADFORD, ARTHUR J.

FOLDABLE SUPPORT

U.S. Pat. No. 2,480,702

In a foldable support, a base. A pair of elongated supporting members are pivoted to the base on a lateral axis relatively to the base, and are additionally pivoted to the base on a longitudinal axis relatively thereto. A means is for automatically moving the supporting members laterally away from each other in response to their being swung longitudinally away from the base.

TOBOLSKI THADDEUS

FOLDING WORKTABLE APPARATUS

U.S. Pat. No. 4,102,555

A worktable has first and second spaced leg assemblies with a table pivotally secured to the first leg assembly for vertical storage positioning against the first leg assembly and a horizontal work position with a free outer end resting on the leg assembly. A two-piece flat shelf has a first member hinged to the first leg assembly and a second member hinged to the second leg assembly. The shelf members having abutting inner edges with a releasable clamp unit connecting the inner edges. A V-shaped stabilizer unit includes a first and second brace member with a top end secured to the tops of the leg assemblies and a bottom end secured to the shelf members. The brace members may be connected to the shelf members and collapsible, or may be pivotally connected to each other and releasably connected to the shelf members for folding to a storage position, with the table abutting the first leg assembly and the shelf members abutting the leg assemblies.

DuRAPAU, KENRICK J.

TABLE TOP ATTACHMENT FOR SAWHORSES

U.S. Pat. No. 5,535,847

A table top attachment for a sawhorse includes a table top member and a brace member. The table top member has a planar top surface and a lower surface that includes a series of tab members that snugly mate with the top beam of a sawhorse in an attached position, to prevent the table top member from moving laterally with respect to the top beam and allowing the top beam to support the table top member. The brace member is connected at one end to the table top member along one edge of the table top and at an opposite end to one of the sawhorse side supports. When connected to the sawhorse side support, the brace cooperates with the sawhorse top beam to support the table top in the attached position.

SUMMARY OF THE INVENTION

A primary object of the present invention is to provide a foldable sawhorse/worktable that will overcome the shortcomings of the prior art devices.

Another object is to provide a foldable sawhorse/worktable that can be placed into a folded position, to be conveniently stored when not in use, and is lightweight enough so that it can be easily carried with one arm.

An additional object is to provide a foldable sawhorse/worktable that can be placed into an unfolded working position, in which its work platform can support various types of power tools, such as miter saws, skill saws and of course all kinds of construction materials.

A further object is to provide a foldable sawhorse/worktable that is simple and easy to use.

A still further object is to provide a foldable sawhorse/worktable that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DESCRIPTION OF THE PREFERRED EMBODIMENTS

Figure 1:
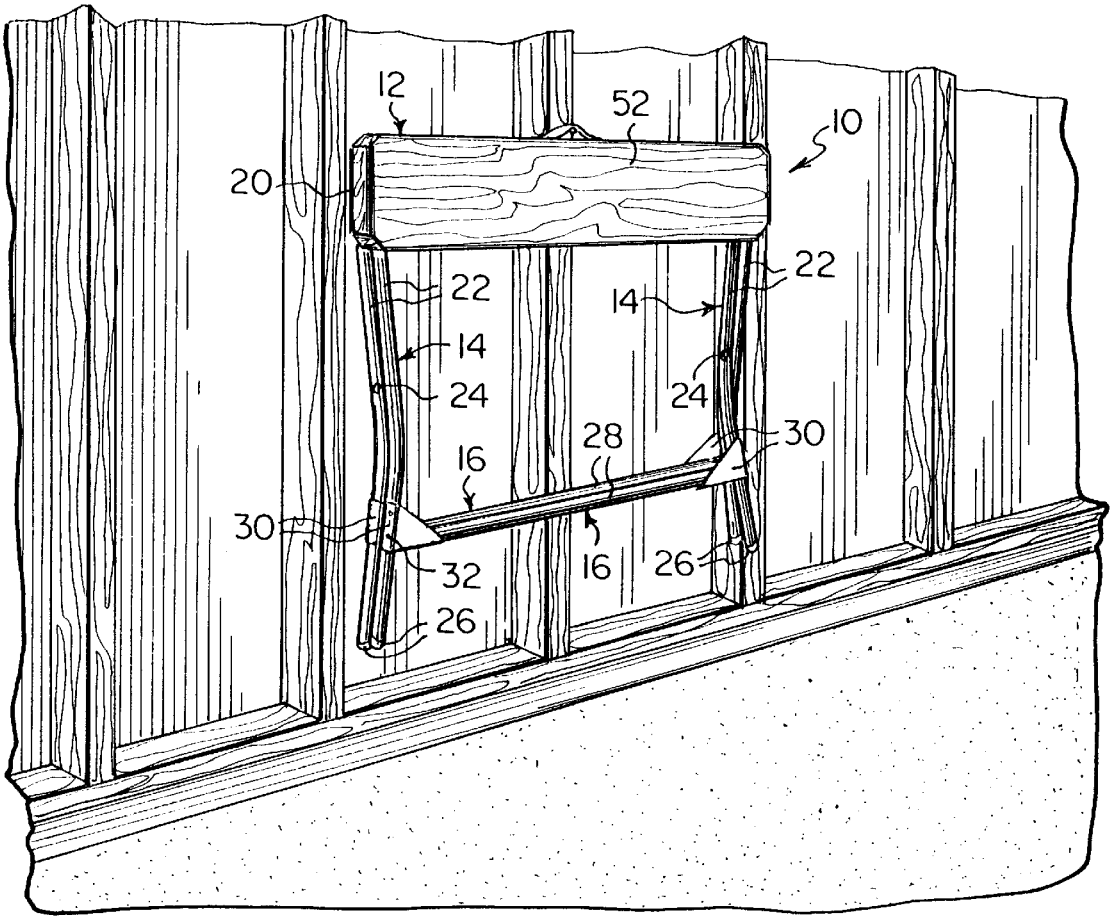
FIG. 1 is a rear perspective view of the present invention in a folded position and stored onto a wall stud in a garage.
Figure 2:
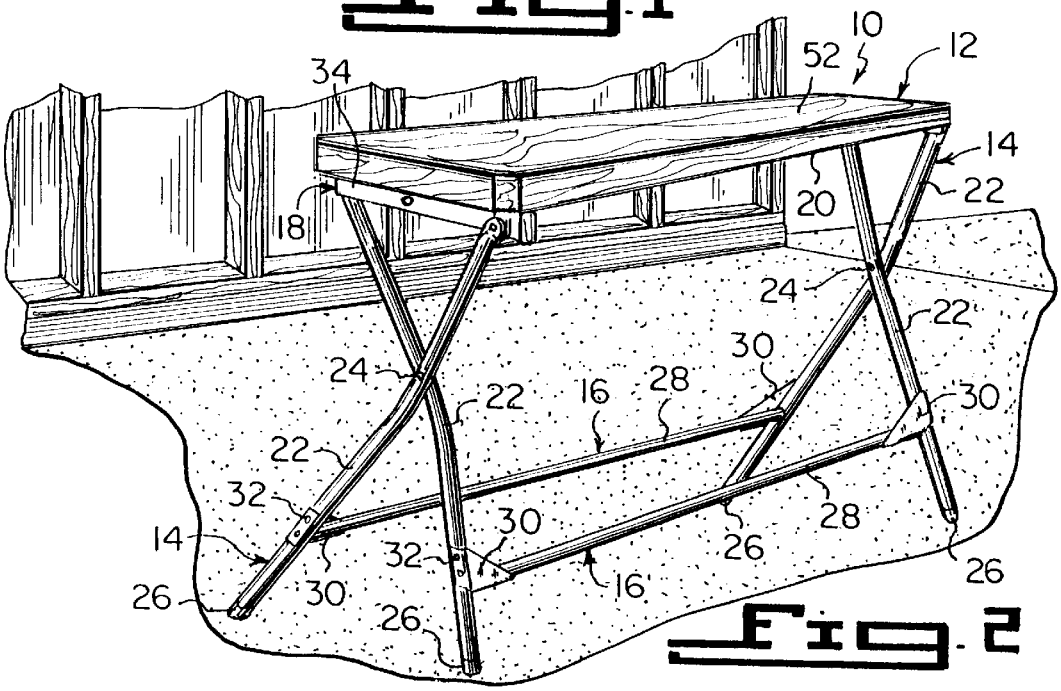
FIG. 2 is a rear perspective view of the present invention in an unfolded working position in the garage.
Figure 3:
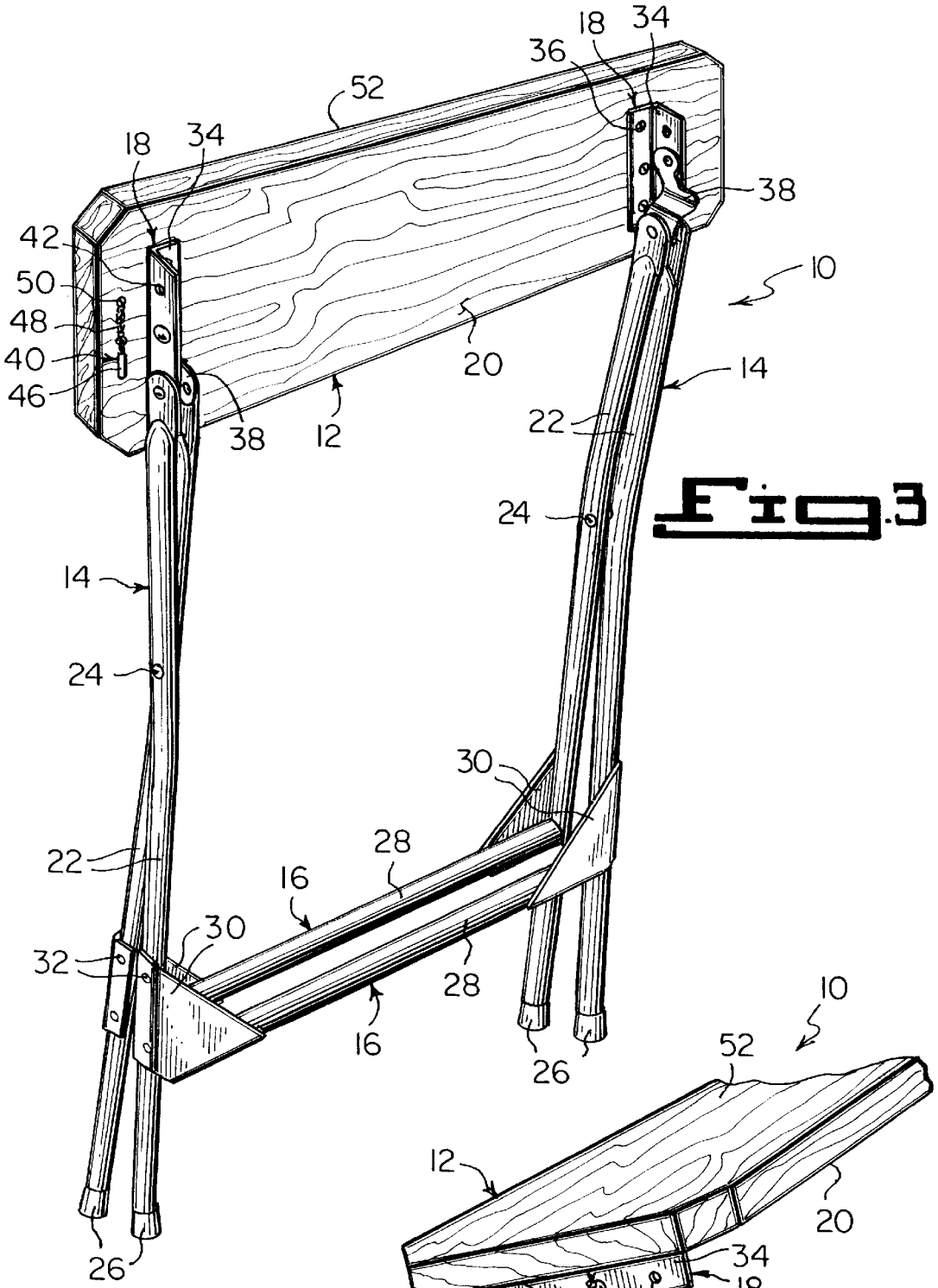
FIG. 3 is a front perspective view of the present invention in the folded position.
Figure 4:
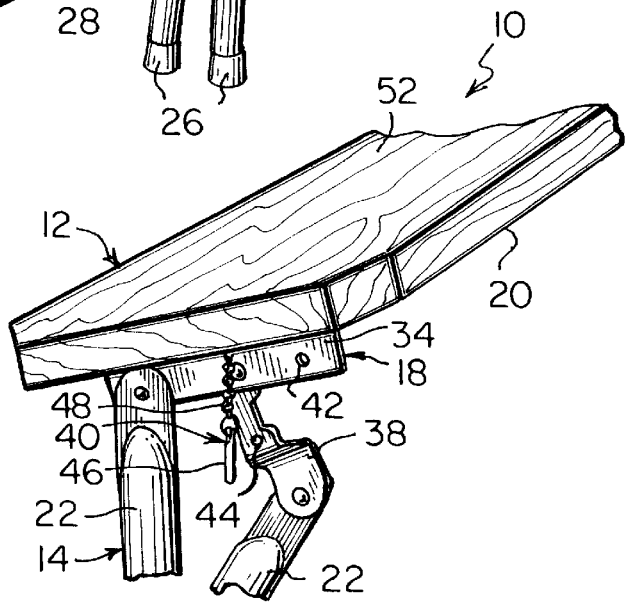
FIG. 4 is a front perspective view of the present invention with parts broken away and partly unfolded.
Figure 5:
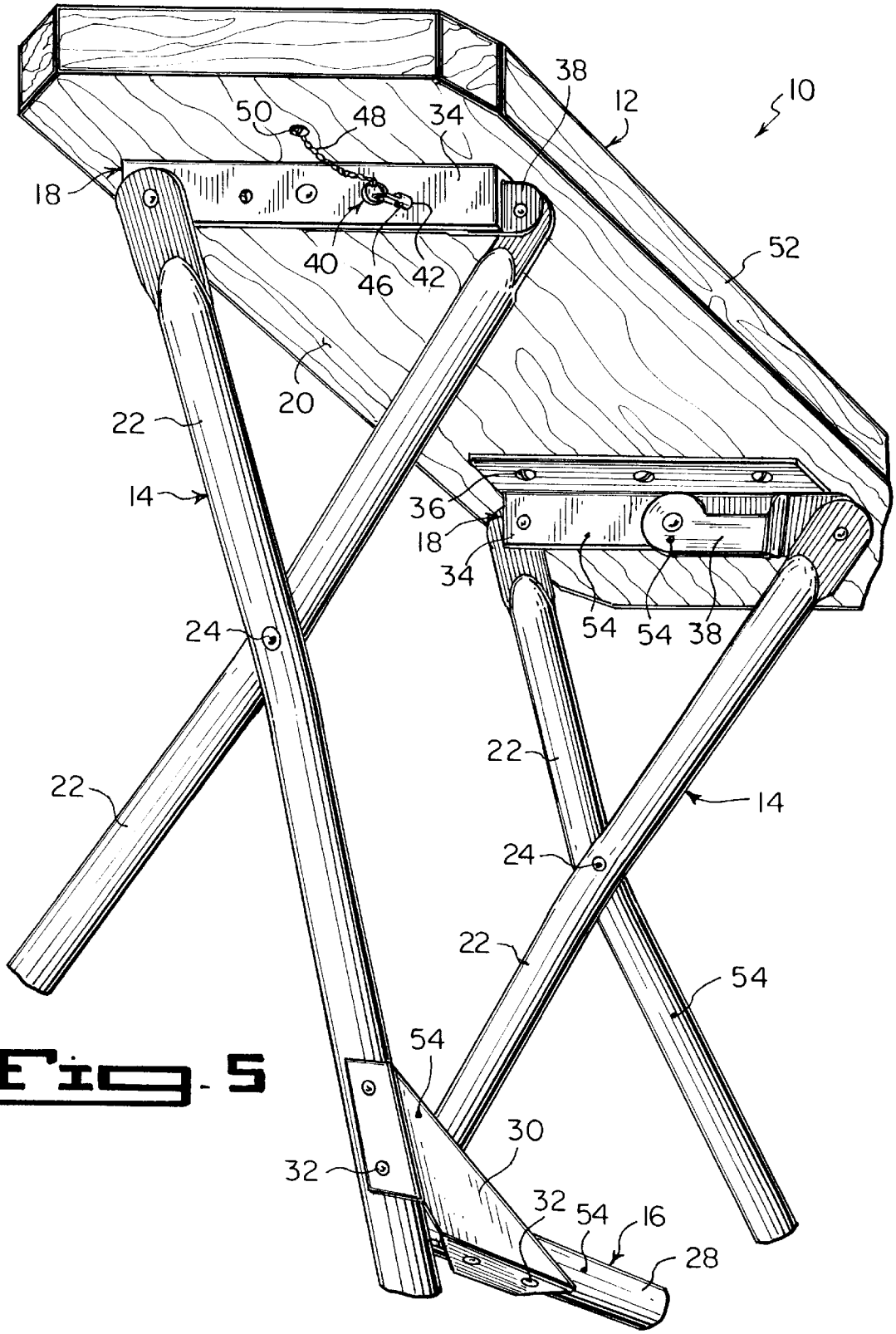
FIG. 5 is a front perspective view of the present invention looking up at the work top, with parts broken away and in the unfolded working position.

Turning now descriptively to the drawings, in which similar reference characters denote similar elements throughout the several views, FIGS. 1 through 5 illustrate the present invention being a foldable sawhorse/worktable 10. With regard to the reference numerals used, the following numbering is used throughout the various drawing figures.

10 foldable sawhorse/worktable

12 work platform of 10

14 scissor side support assembly of 10

16 cross brace of 10

18 pivotally mounting structure of 10

20 underside of 12

22 leg member of 14

24 pivot pin of 14

26 non-skid shoe cap on 22

28 elongate rod of 16

30 connector of 16

32 fastener of 16

34 L-shaped bracket of 18

36 fastener of 18

38 arm of 18

40 locking facility

42 aperture in 34 of 40

44 hole in 38 of 40

46 peg of 40

48 chain of 40

50 fastener of 40

52 elongate rectangular wooden board for 12

54 durable metal material for 22, 28, 30, 34 and 38

The foldable sawhorse/worktable 10 comprises a work platform 12, a pair of scissor side support assemblies 14 and a pair of cross braces 16 horizontally extending between the scissor side support assemblies 14 for stabilization purposes. Structures 18 are for pivotally mounting top ends of each scissor side support assembly 14 to the underside 20 of the work platform 12. It can be placed into a folded position with the work platform 12 vertical to be conveniently stored, as in FIGS. 1 and 3, and can be placed into an unfolded working position with the work platform 12 horizontal to support various types of power tools and all kinds of construction materials, as in FIGS. 2 and 5.

Each scissor side support assembly 14 includes two tubular crisscrossed leg members 22. A pivot pin 24 extends through the crisscross intersection of the leg members 22. Each leg member 22 contains a non-skid shoe cap 26 on a lower end thereof to prevent slippage.

Each cross brace 16 comprises an elongate rod 28 and a pair of connectors 30. A plurality of fasteners 32 are provided, for attaching the first connector 30 between a first end of the elongate rod 28 and one leg member 22 of the first scissors side support assembly 14, and for attaching the second connector 30 between a second end of the elongate rod 28 and one matching leg member 22 of the second scissor side support assembly 14.

Each pivotally mounting structure 18 includes an L-shaped shaped bracket 34. A plurality of fasteners 36 are for securing the L-shaped bracket 34 to the underside 20 of the work platform 12. An arm 38 is pivoted at one end to the L-shaped shaped bracket 34. A top end of the first leg member 22 of the scissor side support assembly 14 is connected in a pivotal manner to a second end of the arm 38. A top end of the second leg member 22 of the scissor slide support assembly 14 is connected in a pivotal manner to the L-shaped bracket 34.

A facility 40 is for locking the arm 38 to the L-shaped shaped bracket 34, when the work platform 12 is horizontal and the scissor side support assemblies 14 are in the unfolded working position. The locking facility 40 consists of the L-shaped bracket 34 having an aperture 42 therethrough. The arm 38 has a hole 44 therethrough being in alignment with the aperture 42 in the L-shaped bracket 34, when the scissor side support assemblies 14 are in the unfolded working position. A peg 46 is inserted through the aperture 42 in the L-shaped bracket 34 and the hole 44 in the arm 38, to prevent the arm 38 from pivoting on the L-shaped bracket 34.

A chain 48 is affixed at a first end to the peg 46. A fastener 50 attaches a second end of the chain to the underside 20 of the work platform 12, to prevent the loss of the peg 46 when disengaged from the L-shaped bracket 44 and the arm 38.

The work platform 12 is an elongate rectangular wooden board 52. Each leg member 22 is fabricated out of a durable metal material 54. Each elongated rod 28 and connector 30 are fabricated out of the durable metal material 54. Each L-shaped bracket 34 and the arm 38 are also fabricated out of the durable metal material 54.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A foldable sawhorse/worktable comprising:

a) a rectangular work platform;

b) a pair of scissor side support assemblies each comprising two tubular crisscrossed leg members and a pivot pin extending through the crisscross intersection of said leg members and each leg member having a non-skid shoe cap on a lower end thereof to prevent slippage;

c) a pair of cross braces horizontally extending between said scissor side support assemblies for stabilization purposes, each cross brace comprising an elongate rod, a pair of connectors, and a plurality of fasteners for attaching one connector between a first end of said elongate rod and one said leg member of one scissors side support assembly and for attaching another connector between a second end of said elongate rod and the matching leg member of the other scissor side support assembly, each of said connectors being in the shape of a right triangle with the right angle sides of said connectors being partially wrapped around the adjoining legs and elongate rods;

d) means for pivotally mounting top ends of each said scissor side support assembly to the underside of said work platform each pivotally mounting means comprising an L-shaped bracket, a plurality of fasteners for securing said L-shaped bracket to the underside of said work platform, and an arm pivoted at one end to said L-shaped brackets, with a top end of one leg member of each scissor side support assembly connected in a pivotal manner to a second end of said arm while a top end of the second leg member of said scissor side support assembly is connected in a pivotal manner directly to said L-shaped bracket, so that said sawhorse/worktable can be placed into a folded position with said work platform vertical to be conveniently stored and can be placed into an unfolded working position with said work platform horizontal to support various types of power tools and all kinds of construction materials;

e) means for locking one arm to said L-shaped bracket when said work platform is horizontal and said scissor side support assemblies are in the unfolded working position, said locking means comprising an aperture in said L-shaped bracket, said one arm having a hole therethrough being in alignment with said aperture in said L-shaped bracket when said scissor side support assemblies are in the unfolded working position, and a peg to be inserted through said aperture in said L-shaped bracket and said hole in said arm to prevent said arm from pivoting on said L-shaped bracket, a chain affixed at a first end to said peg and a fastener to attach a second end of said chain to the underside of said work platform to prevent the loss of said peg when disengaged from said L-shaped bracket and arm; and f) each of said leg members having a single bend with the crisscross intersection of said leg members being located at said intersection and both crisscrossed leg members in a pair being bent in the same direction and the bend in one pair being in the opposite direction of the bend of the other pair but in spaced parallel planes to each other and at right angles to said work platform in the folded position.

* * * * *